United States Patent [19]

Shelton

[11] Patent Number: 4,551,927

[45] Date of Patent: Nov. 12, 1985

[54] HANDLING OF TEXTILE YARN

[75] Inventor: William E. A. Shelton, Oadby, England

[73] Assignee: Alan Shelton Limited, Croft, England

[21] Appl. No.: 319,414

[22] Filed: Nov. 9, 1981

[30] Foreign Application Priority Data

Nov. 19, 1980 [GB] United Kingdom ..... 8037021
Aug. 12, 1981 [GB] United Kingdom ..... 8124631

[51] Int. Cl.[4] ..... F26B 21/06

[52] U.S. Cl. ..... 34/82; 34/155; 57/304

[58] Field of Search ..... 34/155, 82, 50; 15/301; 57/304, 305, 308; 68/18 F

[56] References Cited

U.S. PATENT DOCUMENTS 2,066,781 1/1937 Janssen .
2,431,726 12/1947 Bechtler ..... 57/308
3,378,998 4/1968 Shackelford ..... 57/308
4,154,005 5/1979 Pickering et al. ..... 34/155

*Primary Examiner*—Larry I. Schwartz
*Assistant Examiner*—David W. Westphal
*Attorney, Agent, or Firm*—Charles A. Brown; Charles E. Brown

[57] ABSTRACT

The invention relates to the control of loose lint or fly released by textile yarns which are in contact with yarn guides, feeding and tensioning devices and the like during their travel from bobbins to textile machines. According to the invention, creels or yarn feed devices are enclosed within a housing (2, 12, 76, 94) which is divided into a plurality of compartments (A, B, C: A′, B′, C′: A″, B″) at least one of which is traversed by a yarn (Y) during its travel, air circulating means (38, 58, 78, 108) to circulate air in a continuous path through the compartments, and a partition (32, 66, 88, 106) provided between two adjacent compartments comprising a filter screen capable of trapping fly or lint carried by air passing therethrough.

5 Claims, 9 Drawing Figures

FIG. 4
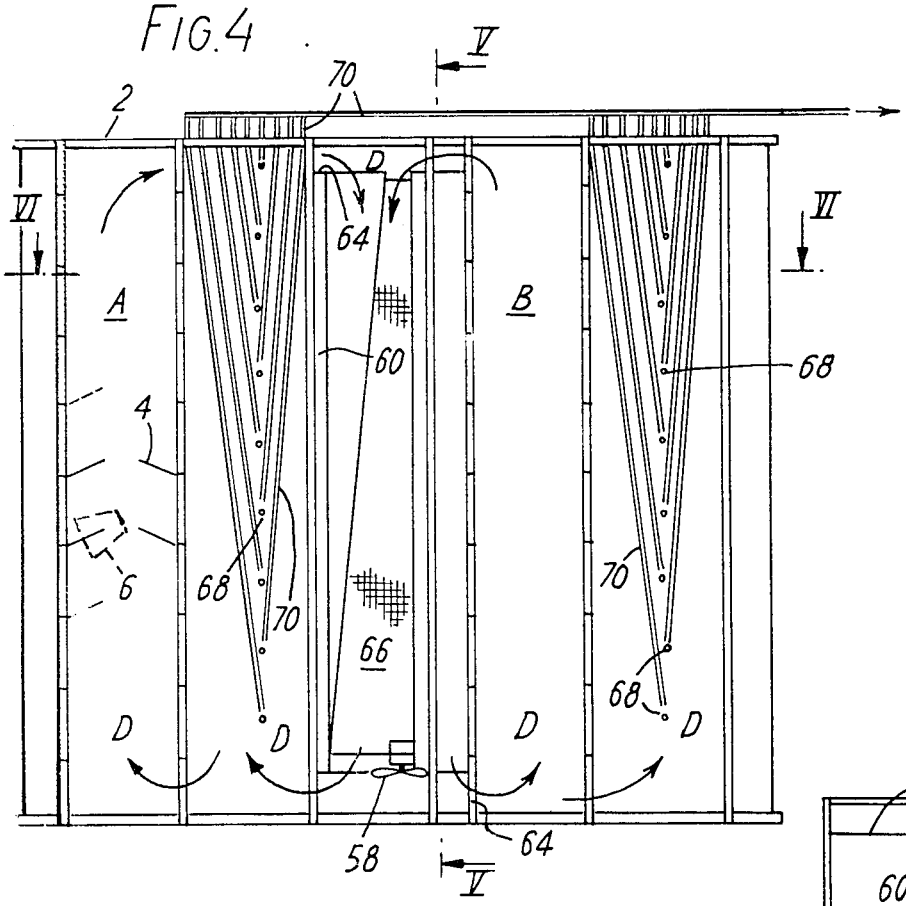
FIG. 5
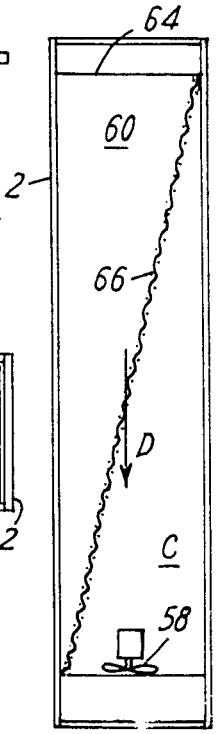
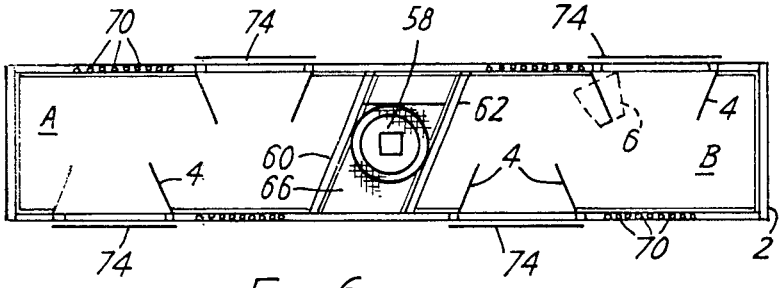
FIG. 6

HANDLING OF TEXTILE YARN

BACKGROUND OF INVENTION

The invention is concerned with improvements in or relating to the handling of textile yarn, particularly the control loose fly or lint released by yarns during a textile manufacturing process.

In the supply of yarn to a textile machine it is customary, for example, to mount a plurality of yarn bobbins upon support members in a creel arrangement, yarn drawn off from the bobbins travelling through yarn guides, feed devices, tensioners, stop motions and the like before it is used by the textile machine.

During this travel, loose fibres are inclined to fall away from the main fibres of the yarn, for instance when they pass over contact points such as the yarn guides and the like mentioned above. These loose fibres are known as 'lint' or 'fly'.

Several problems are caused by lint. For example, lint often accumulates in a yarn guide and tends to block the passage. This may break the yarn either at a position remote from the operational zone of the machine when the yarn detection system will stop the machine, or in the zone itself when a fault in the fabric may be caused. Occasionally, lumps of lint may be taken into the fabric, which will produce faulty fabric, and also may cause damage to the fabric-producing elements (such as needles in a knitting machine). Lint floating in the atmosphere in a work room is a health hazard, and any lint which settles in the work room, particularly in the roof structure, may be a fire hazard. Not least of the problems caused is the risk that lint from a coloured yarn may contaminate adjacent yarn or fabric and result in sub-standard goods.

Many attempts have been made to overcome some of the foregoing problems, mainly consisting of systems to blow the lint away from the contact point in the yarn path which may assist in solving the difficulties associated with the fabric and the machine but does nothing for the hazard problems and indeed may even worsen them.

BRIEF SUMMARY OF THE INVENTION

The invention therefore provides enclosure means for the control of loose lint or fly released by textile yarns during travel between stations in a textile manufacturing process, comprising a housing, divided into a plurality of interconnected compartments, at least one of which is traversed by a yarn during its travel, means to circulate air in a continuous path through the compartments, a partition being provided between two adjacent compartments comprising a filter screen capable of trapping fly or lint carried by air passing therethrough.

Preferably, the housing is provided with individual outlets for each yarn, each outlet having a tubular guide means leading therefrom through which the yarn is guided.

Advantageously, the partition is disposed at a non-vertical angle so that the circulating air passes therethrough with a heightwise component of movement. Conveniently the air circulating means comprises at least one fan arranged so as to provide a directional flow of air.

In an example to be described below means are also provided for introducing humidity into the circulation of air through the compartments.

In most textile manufacturing processes, the yarn travel is rapid and therefore because of the shortness of the time during which the yarn is present in the compartments, it has been found preferable to establish a high level of humidity within the compartments. The effect of this is to reduce to a minimum the effect of static electricity upon the yarn thus removing a major contributory cause of the lint problem. At the same time, the moisture is partially absorbed into the cell structure of the yarn fibres in a manner similar to that of the conditioning of yarn in storage cabinets, but in a fraction of the time. Thus the yarn is strengthened as compared with yarn taken from creels in a conventional arrangement, and the performance of the knitting process is thus improved.

Advantageously, the moisture may be provided by an atomiser/humidifying device which injects moisture-laden air under pressure.

In examples of the invention to be described in detail below, the housing may be divided into two or three compartments, one of which contains the air circulating means.

In one example to be described, a creel arrangement comprising a plurality of bobbin supports for yarn bobbins supplying yarn to a textile machine, is received within one compartment of the housing of an enclosure according to the invention.

It will be found that the problems caused by lint formation in the vicinity of the creel arrangement are lessened to a considerable extent by the use of the enclosure with the tubular outlet guides, the majority of the lint particles released being effectively trapped by the screen, from which they may readily be removed.

Further effective control over the release of fly or lint into the atmosphere of a factory may be achieved by the use of another example of an enclosure according to the invention, which may be provided around the yarn feeding and tensioning devices normally associated with the supply of yarn to a textile machine, for example a knitting machine. Use of an enclosure is facilitated if the devices are arranged in a localised manner preferably to one side of the knitting machines in contrast to the usual annular array.

It may thus be found convenient to use an arrangement of yarn feed devices arranged within a housing in a plurality of linear rows, each device receiving one yarn from the creel arrangement and accepting a suitable number of turns of said yarn, to feed it forward to the machine. The housing will, according to the invention, be provided with a plurality of compartments, an air circulation means and a fine screen partition to trap lint.

In the examples of the invention to be described in detail below, the knitting machine is a circular knitting machine having seventy two feed stations, although it will be understood that the benefits of the invention may be obtained with multifeed machines having as few as, say, twenty four stations. The yarns supplied to the machine in the example are divided into two groups each group being drawn from a creel supporting the requisite number of bobbins to maintain a continuous supply of thirty six yarns.

Each group of thirty-six yarns is controlled by thirty six feed devices contained within a housing, two housings being arranged to form a double cabinet if convenient.

BRIEF DESCRIPTION OF DRAWINGS

There will now be given a description of four examples of enclosures according to the invention. It will be understood that the description, which is intended to be read with reference to the drawings, is given by way of example only and not by way of limitation.

In the drawings:

FIG. 4 is an enlarged diagrammatic view in side elevation of the other enclosure according to the invention having a side panel omitted;

FIG. 5 is a vertical sectional view of the enclosure of FIG. 4 taken on line V—V of FIG. 4;

FIG. 6 is a horizontal sectional view taken on line VI—VI of FIG. 4;

DETAILED DESCRIPTION OF DRAWINGS

Figure 1:
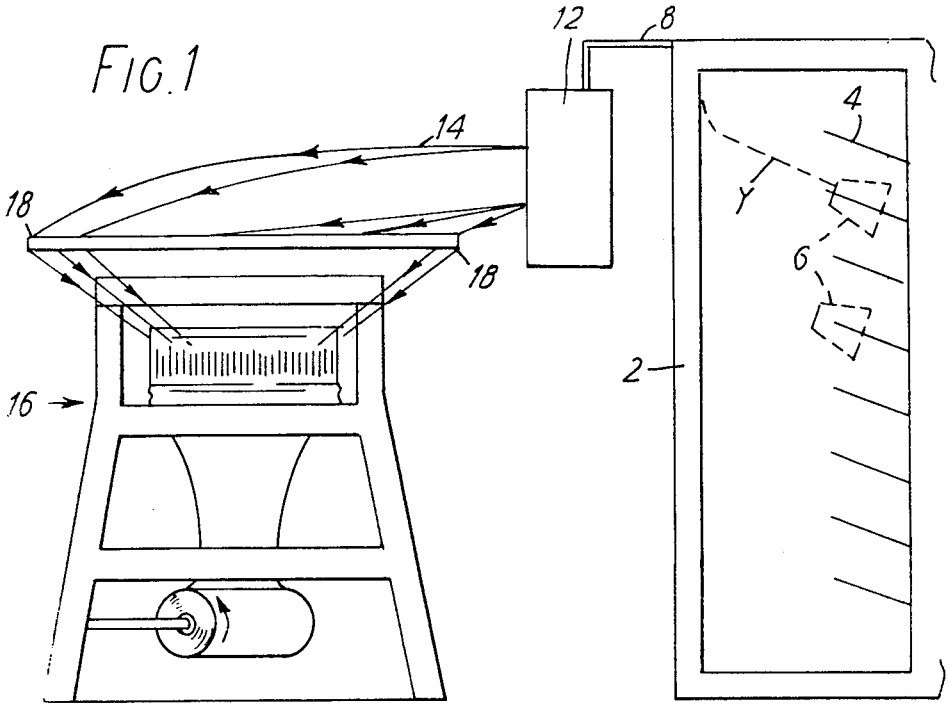
FIG. 1 is a diagrammatic side elevational view of a circular knitting machine including two yarn enclosures according to the invention.
Figure 2:
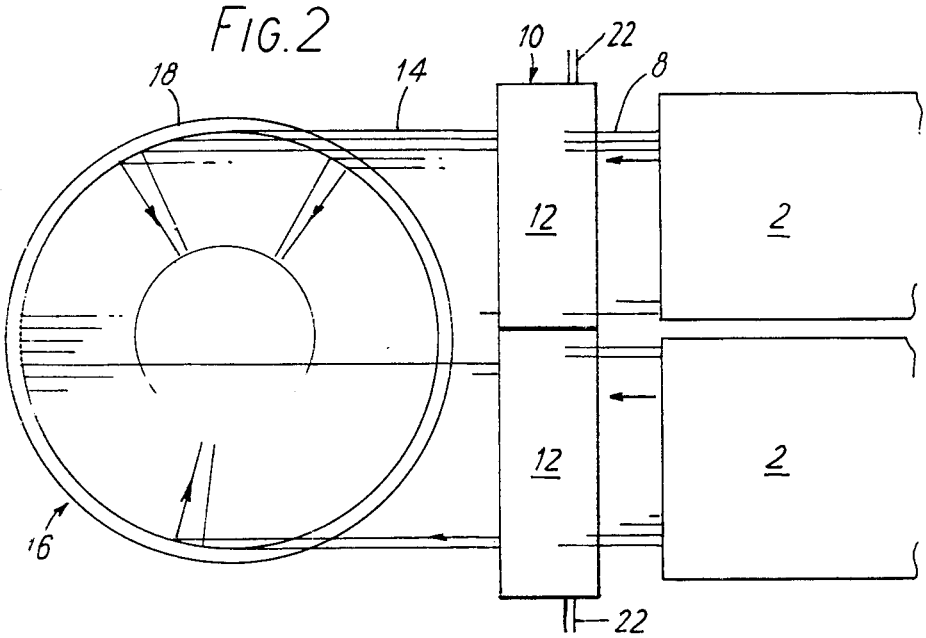
FIG. 2 is a top plan view of the circular knitting machine and the enclosures.

Two examples of enclosures are illustrated in the arrangement shown in FIGS. 1 and 2. The arrangement includes a housing 2 having panels entirely enclosing a plurality of bobbin support rods 4 (only a few of which are shown in FIG. 1) upon each of which is supported in use a bobbin of yarn (indicated at 6 in dotted lines). The rods 4 are arranged in pairs in the conventional manner and are arranged to project from a framework of the housing in four columns of nine rows in the present example. Access to each column of bobbins is obtained by providing removable panels which extend the height of the housing.

Each yarn led from the bobbins 6 leaves the housing 2 through a tubular guide means 8 and is guided to cabinet 10 comprising two further enclosures 12 each containing thirty six yarn feeder devices 20 which in the present example comprise feed drums each rotating about a vertical axis, but which may comprise any suitable feeding and tensioning device.

Each yarn, having travelled around its associated yarn feeder device 20 then leaves the housing 12 through individual tubular guide means 14 to a circular knitting machine (indicated a 16) having seventy two feed stations arranged upon a circular framework 18, and thence to the operating region of the needles (not shown).

Figure 3:
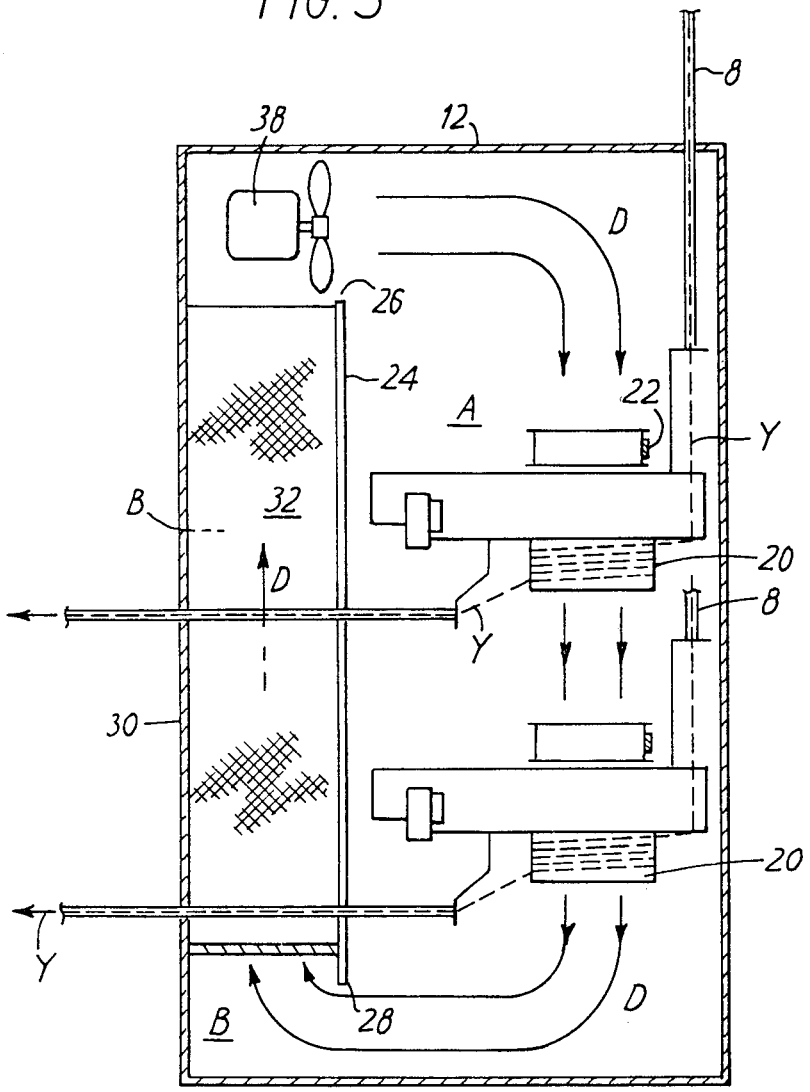
FIG. 3 is an enlarged side elevational view of one of the enclosures with one end plate removed for clarity.

FIG. 3 shows the construction of one of the two identical housings 12. Each yarn feeder device 20 is driven by a belt 22 passing through the housing and driven so as to operate at a speed compatible with the knitting machine 16. Yarn Y entering the housing 12 through guide tubes 8 is received around the device 20 in five turns and leaves the housing through the guide tubes 14.

The housing 12 is divided into two interconnecting compartments, A and B, by a vertical wall 24 extending between the two end plates (one removed for clarity), leaving a gap 26 at the upper edge thereof and a gap 28 at the lower edge. Secured to a back-plate 30 of the housing and also to the wall 24 is a partition 32 comprising a fine filter screen capable of trapping lint. The partition 32 is secured to the back-plate 30 at an inclined angle, the upper portion thereof being furthest from the viewer in FIG. 3. The lower portion being normally abutting the removed end plate.

Arranged at an upper region of the housing 12 adjacent the gap 26 is a fan 38 arranged to produce a circulation of air within the housing in the direction of arrows D. Thus air is forced downwards past the yarn Y as it is wrapped around the devices 20, and thus entrains any loose fly or lint. The circulation path then leads the air across the gap 28 and upwardly through the partition 32 to deposit the lint on the fine mesh screen. It will be understood that the direction of air flow through the partition may be downwardly if preferred. In the present example, clean air emerges from the gap 26 having been re-circulated by the fan 38.

Thus the free lint remaining after the yarn has left the creel housing 2 is satisfactorily dealt with. However, the largest proportion of lint is removed within the creel housing 2 and the construction and arrangement of this will now be described.

Within the housing 2 are three main compartments, a first and a second compartment indicated at A and B respectively and a third compartment C, which contains a fan 58, positioned so as to create and maintain an air circulation throught the housing in the direction of arrows D, see FIG. 4.

Internal dividing walls 60 and 62 extend widthwise across the housing but leave gaps 64 at the top and bottom thereof to allow communication between the compartments A and C, and C and B. The angle at which the walls 60 and 62 are set allows maximum economy of space within the housing with respect to the position of the bobbins.

A further partition 66 is provided which, as may be seen in FIG. 5, runs obliquely from the upper edge at the right hand side of the walls 60 and 62 (as viewed in FIG. 5) to the bottom edge at the left hand side of the walls 60 and 62. This obliquely disposed partition comprises a fine filter screen capable of trapping lint and is so arranged to maximise the filter surface with which the lint may come into contact.

Access panels 74 are provided for loading bobbins 6 onto the supports 4 and each yarn, drawn from one of the operative bobbins 6 during the operation of the circular knitting machine, leaves the housing through a separate outlet aperture 68, of which there are eighteen arranged on each of the two main side panels of the housing 2.

Immediately adjacent each of the outlet apertures 68 is a separate tubular guide 70 through which the yarn is led up to the level of the top of the housing and towards the textile machine. In the present example, all the yarns are led to one of the plurality of feed devices 20 provided in the housings 12.

The operation of the housing 2 is as follows. When the fan 58 is operating, air is drawn downwards in the compartment C and spreads outwardly at the lower portion thereof to enter the compartments A and B respectively through the lower gaps 64. The air then rises through the compartments A and B entraining any lint which forms from the yarn. The lint-laden air is then drawn towards the central upper region of the housing above the partition 66. The downward air current caused at this region by the fan 58 draws the lint-laden air through the filter screen of the partition, so that the lint is retained by the mesh from which it may be removed at intervals.

Figure 7:
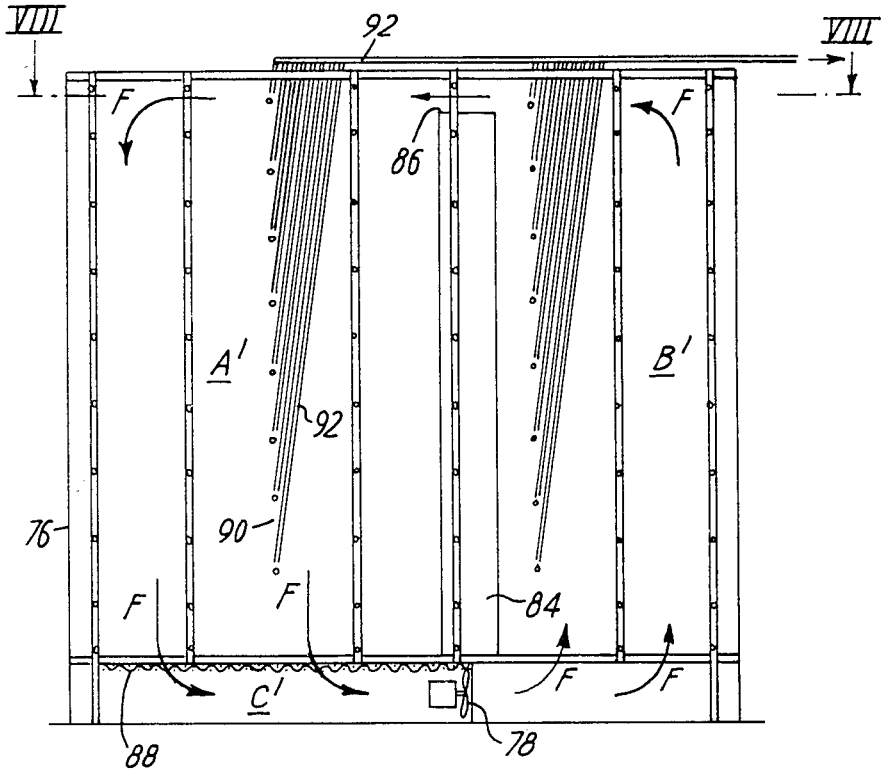
FIG. 7 is diagrammatic view in side elevation of an enclosure which is a modification of the enclosure of FIGS. 4–6.
Figure 8:
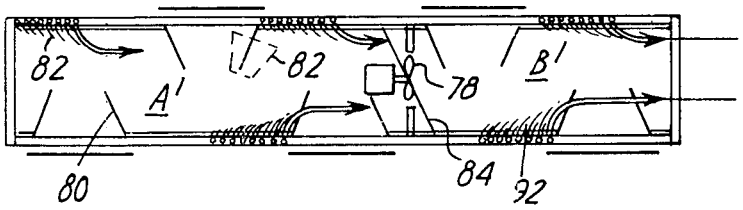
FIG. 8 is a horizontal sectional view taken on line VIII—VIII of FIG. 7.

An alternative arrangement is shown in FIGS. 7 and 8, in which a housing 76 encloses three compartments A', B' and C', the main difference between this example and the one illustrated in FIGS. 1 to 3 being that compartments A and B which stand side-by-side and contain support rods 80 for bobbins 82. A partition 84, set at an angle, divides the compartments A' and B' except for a gap 86 left at an upper edge thereof. In this example, the air flow, indicated bv arrows F, is upwardly through compartment B', across to the upper portion of compartment A' and downwardly through the mesh of a horizontal filter screen partition 88 at the bottom of the compartment A', and along compartment C', to the fan 78 and thence upwardly again to compartment B'. Outlet apertures 90 and tubular guides 92 are provided as before.

Figure 9:
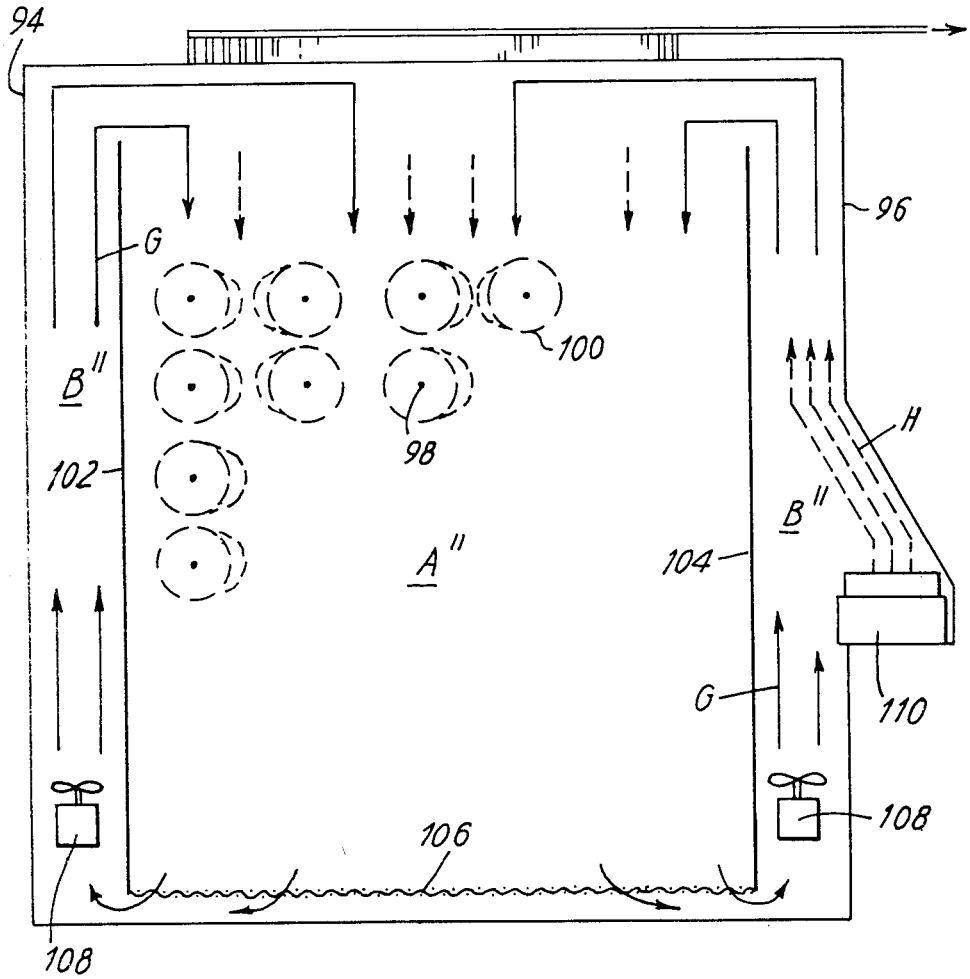
FIG. 9 is a diagrammatic view in side elevation of an enclosure which is a modification of the enclosure of FIG. 3.

Another alternative arrangement of creel housing is shown in FIG. 9.

The arrangement comprises a housing 94 having panels, including a rear panel 96, entirely enclosing a plurality of bobbin support rods 98 with bobbins 100. Within the housing is a main compartment indicated at A" and a second, U-shaped, compartment B" the arms of the U-shape being divided from the main compartments by dividing walls 102 and 104, and the bridging portion of the U-shape being separated therefrom by a fine filter screen partition 106. Fans 108 are provided to ensure an air circulation in the housing as indicated by arrows G drawn in full-line.

An atomiser/humidifier 110, incorporating a pump, is positioned in the rear panel 96 so as to force moist air (indicated by arrows H drawn in broken line), upwardly into the air circulation rising from the adjacent fan 168.

It will be understood that the use of the humidifier is optional within the housing described, the layout of the latter being equally suitable for use with relatively dry air where the nature of the yarn permits.

I claim:

1. Enclosure means for the control of loose lint or fly released by textile yarns during travel between stations in a textile manufacturing process, comprising a completely enclosed housing, a plurality of interconnected compartments within the housing, at least one of which compartments is traversed by a yarn during its travel, air circulation means within said housing to circulate essentially the same air in a continuous path through the entire cross sectional areas of said compartments with the air first passing through said one compartment and then an other of said compartments, and a partition provided within the other of said compartments comprising a filter screen capable of trapping fly or lint carried by air passing therethrough, and means contained within said completely enclosed housing for conditioning said circulating air, said housing enclosing a plurality of yarn bobbin supports comprising a creel arrangement.

2. Enclosure means as claimed in claim 1 wherein access panels are provided in the housing for re-loading the bobbin supports.

3. Enclosure means as claimed in claim 1 wherein a further completely enclosed housing is provided which encloses a yarn feed arrangement.

4. Enclosure means according to claim 3 wherein a partition divides said further housing into adjacent compartments, means for circulating air sequentially through said compartments, said yarn feed arrangement being in one of said adjacent compartments, and a filter traversing the other of said compartments for removing dust and lint.

5. Enclosure means according to claim 4 wherein there are yarn guide tubes leading into said one compartment of said further enclosure to said yarn feed arrangement and yarn guide tubes leading from said yarn feed arrangement to the exterior of said further enclosure.

* * * * *